US006681800B2

(12) United States Patent
Rüdle et al.

(10) Patent No.: US 6,681,800 B2
(45) Date of Patent: Jan. 27, 2004

(54) CONTROL VALVE MEANS AND FURTHERMORE A VALVE SUITABLE FOR USE AS A COMPONENT THEREOF

(75) Inventors: Manfred Rüdle, Esslingen (DE); Michael Berner, Kirchheim (DE)

(73) Assignee: Festo AG & Co., Esslingen (DE)

( * ) Notice: Subject to any disclaimer, the term of this patent is extended or adjusted under 35 U.S.C. 154(b) by 215 days.

(21) Appl. No.: 09/909,283

(22) Filed: Jul. 19, 2001

(65) Prior Publication Data

US 2002/0017625 A1 Feb. 14, 2002

(30) Foreign Application Priority Data

Aug. 8, 2000 (EP) ..... 00117006

(51) Int. Cl.[7] ..... E03B 1/00; F17D 1/00
(52) U.S. Cl. ..... 137/560; 137/560
(58) Field of Search ..... 137/560, 884; 439/320

(56) References Cited

U.S. PATENT DOCUMENTS 3,098,635 A * 7/1963 Delaporte et al. ..... 251/54
3,850,495 A * 11/1974 Glover ..... 439/273
4,507,707 A 3/1985 Willis

FOREIGN PATENT DOCUMENTS

DE 28 13 562 A1 10/1978
DE 42 22 637 A1 1/1994
DE 43 25 980 A1 2/1995
EP 0 487 173 A1 5/1992
EP 0 629 783 B1 12/1994
FR 741 118 A1 5/1997

OTHER PUBLICATIONS

Siemens Schweiz AG, "Kompaktmodule K46 für das AS–Interface: Praktisch klein mit schneller Diagnose", NN, Online XP002159405, found in Internet on Oct. 4, 2000, copyright 1998.

* cited by examiner

*Primary Examiner*—Edward K. Look
*Assistant Examiner*—John K Fristoe, Jr.
(74) *Attorney, Agent, or Firm*—Hoffmann & Baron, LLP

(57) ABSTRACT

A control means which possesses an electrical control unit having a bus connection, electronic circuitry and at least one electrical output. On the latter a valve is connection by means of cooperating connection means, said valve serving for the control of fluid flows, the two connection means providing for both electrical contact and also fixation of the valve in place. Furthermore, an electrically actuated valve is provided by the invention, which is held in place exclusively by a single connection means on a control unit and is provided with electrical plug contact means, which render possible connection with such electrical plug contact means of the electronic control unit, whose plug contact elements are arranged in quicunx.

16 Claims, 2 Drawing Sheets

CONTROL VALVE MEANS AND FURTHERMORE A VALVE SUITABLE FOR USE AS A COMPONENT THEREOF

BACKGROUND OF THE INVENTION

The invention relates firstly to a control means comprising an electronic control unit having a bus connection, electronic circuitry and at least one electrical output, the electrical output being provided with a first connection means exhibiting first electrical plug contact means and first mechanical attachment means, such first connection means serving for making electrical contact and at the same time for mechanical attachment of a connect component, such connect component possessing a second connection means cooperating in a detachable manner with the first connection means, such connection means having second electrical plug contact means and second mechanical attachment means.

Furthermore, the invention relates to an electrically activated valve, which more particularly is designed to be employed in connection with such a control means.

THE PRIOR ART

A control means of this type is for instance described in the Internet text entitled "Kompaktmodule K45, digital" 1999. The control means comprises a control unit termed a compact module, which possesses a bus connection, electronic circuitry and furthermore at least one or more electrical outputs. The electrical outputs are provided with first connection means, which permit the connection of connect components, with which a connection with an electrically controlled device, as for example a relay, may be produced. In this case a plug-like connect component is connected with the electrical outputs, and is connected with the aid of a cable with the device to be driven. The electrical plug contact means provided on the respective electrical output possess plug contact elements arranged in a quicunx array, whose connection is selected to be in accordance with the respective control purpose. Normally, the electronic control means is supplied with signals by the intermediary of a field bus, which are interpreted in integrated electronic circuitry and switched to the associated outputs present.

The known control means is a product specifically designed for driving electrical components. In addition to purely electrical control purposes the automation sector is however also dominated as well by combined electro-fluidic and, in this respect, more especially electro-pneumatic control requirements. In such cases so far special purpose control means have regularly been utilized, which have both an electronic control unit and also a plurality of valves arranged in a row like a battery, the valves being attached to a fluid distribution board and simultaneously being connected via electrical plug contact means, which are independent from the attachment means, with the electronic control unit. In this respect the plug contact means are designed in accordance with the purposes dictated by the valves. Such a control means is disclosed in the European patent publication 0 629 783 B1 for example.

In addition the control means of the said European patent publication 0 629 783 B1 comprises a plurality of electrical outputs, which are employed for driving electrical components, as for example in the form of valve drives. Their use is however limited to the connection of electrical lines, which lead to externally placed valve drives. However, when the valves are designed as a component of the control means, the making of electrical contact usually involves the use of plug contact means present in accordance with the specific valves present. In the field of automation technology however hybrid systems may be required which make it necessary to provide machines and plant, which is principally on an electrical basis, with fluid power components to a certain extent, as for instance in the form of drives operated by fluid power. However, their use then leads to a need for a certain number of valves in addition so that it is necessary to supplement control means designed using the above mentioned compact modules with control means of the type described in the said European patent publication 0 629 783 B1. But this involves relatively high costs.

SHORT SUMMARY OF THE INVENTION

One object of the invention is accordingly to provide a control means, which makes it possible for users and designers of principally electrical and electronic systems to include fluid power valves in their control technology. A further aim is to propose an electrically actuated valve which is more especially suitable for use in conjunction with electronic control units.

The first aim noted is advantageously achieved in the invention using a control means of the type initially mentioned, in the case of which the connect component is directly constituted by an electrically actuated valve, which is exclusively electrically contacted and mechanically mounted with the aid of the mutually cooperating connection means.

The second aim named is achieved with the use of an electrically actuated valve, which possesses a second connecting means provided for direct connection with a first electrical output, provided with a first electrical connection means, of an electronic control unit, the second connection means exhibiting second electrical plug contact means, which cooperate in the condition connected with the electrical output with first electrical plug contact means of the first connection means, said electrical plug contact means provided on the valve being so designed that same render possible a direct electrical contact with the first electrical plug contact means of the control means, which control means possesses plug contact means arranged in a guincunx array.

Furthermore, the said second mentioned aim is also alternatively achieved by means of an electrically actuated valve in which all the electrical plug contact means serving for making electrical contact and the mechanical attachment means serving for mechanically fixing in place are collected together in a single, common connection means.

The control means in accordance with the invention renders possible a direct connection of a valve serving for the control of fluid power flows with the electrical output of the electronic control unit. Since the connection means hereby cooperating together not only provide for the making of electrical contact, but also at the same time provide mechanical attachment, it is possible for a commercially available electronic control unit (comparable with those of the initially mentioned type) to be provided with a valve without alterations in architecture. It is merely necessary to change the electrical connections of the electrical plug contact means present to suit needs, something which is possible without any trouble at all and may for instance be performed using the electronic circuitry already present.

Electrical outputs of electrical control units are frequently provided with electrical plug contact means, whose plug contact elements are distributed like in quicunx. In such plug contact array is more particularly as dictated by the said German industrial standard DIN EN 60947-5-2 and is commonly employed. By providing the valve to be controlled at the connection means with electrical plug contact means which render possible a direct electrical contacting with the above noted electrical plug contact means of the electronic control unit, it is possible to produce, without using any intermediate plug or intermediately connected connecting cable, a compact, space-saving subassembly-like combination between an electronic control unit and at least one valve to be driven.

Advantageous further developments of the invention will appear from the claims.

The second connection means provided on the valve is preferably located on an electrically actuated valve drive, which assumes the function of a carrier for the valve means, to be actuated by it, of the valve. The entire valve is consequently exclusively connected electrically and mechanically by way of the valve drive or, respectively, the second connection means, which is provided thereon and is more particularly integrated in the valve drive, electrically and mechanically with the control unit.

If the valve has an elongated shape, placement of the second connection means is recommended on an end side of the valve. Consequently in its mounted state the valve is installed with its longitudinal axis perpendicular to the principal extent of the control unit, something which renders possible optimum use of the base face of the electronic control unit.

The electrical plug contact means cooperating with one another are preferably designed in the form of plugs and sockets or sleeves. Preferably, the socket is located on the electronic control unit, whereas the plug is arranged on the valve.

In order to drive an associated load the valve is best provided only with fluid duct connections for the connection of fluid ducts leading to other equipment so that customized arrangements of the fluid ducts are possible. It is preferred for all fluid duct connections to be provided on the side, which faces away from the second connection means, of the valve so that no space is required for outgoing fluid ducts to the side of the valve.

The control unit may comprise a plurality of electrical outputs, which are completely or partially fitted with valves. It is more especially possible to also provide a mixed or hybrid fitting on the one hand with valves and on the other hand with plug-like connect components, which lead by way of connected electrical cables to other electrical or electronic components. The control means may moreover also be equipped with electrical inputs in order to feed any desired signals to it, as for example sensor signals.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

DETAILED ACCOUNT OF WORKING EMBODIMENT OF THE INVENTION

Figure 1:
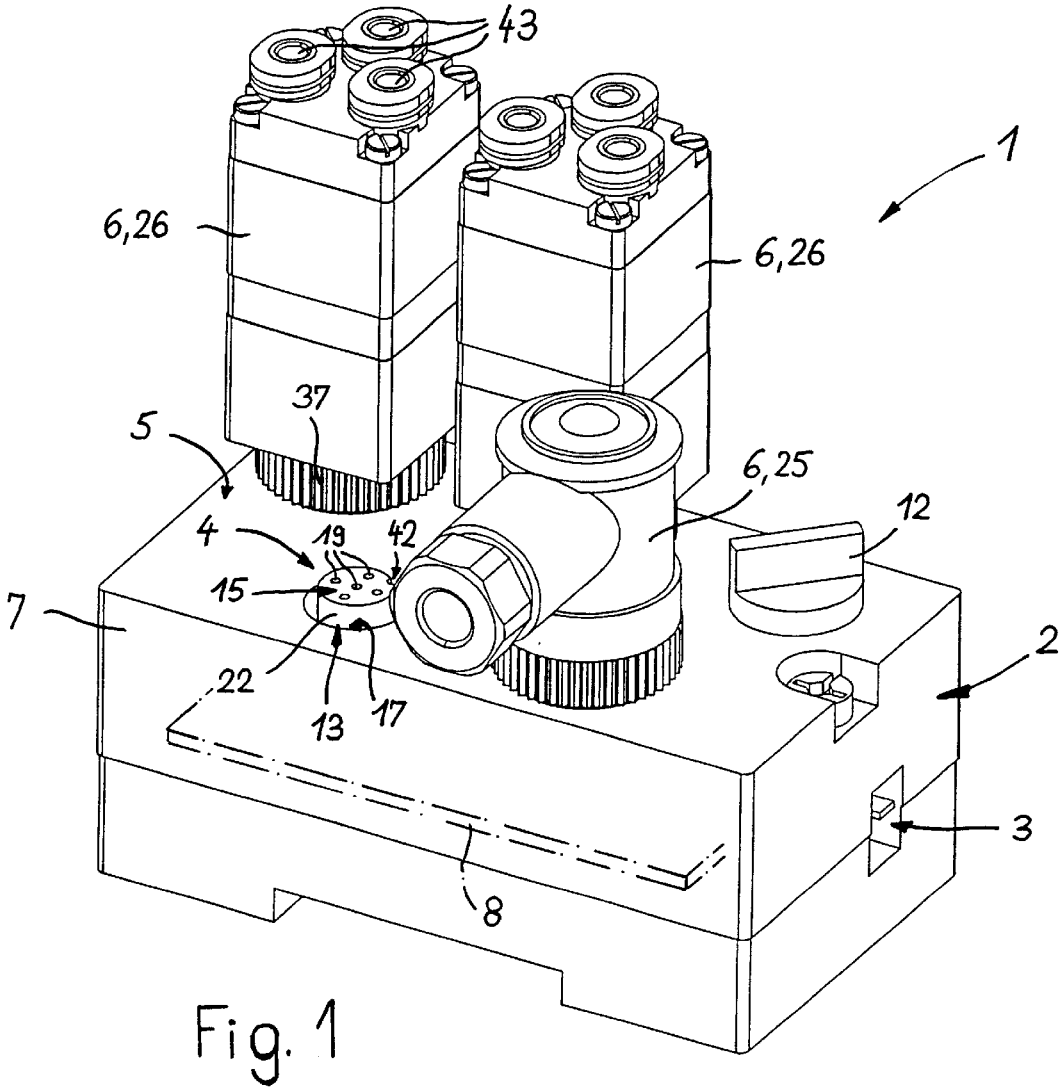
FIG. 1 shows a first embodiment of the control means of the invention, which is provided with the valve in accordance with the valves of the invention in an also preferred embodiment.
Figure 2:
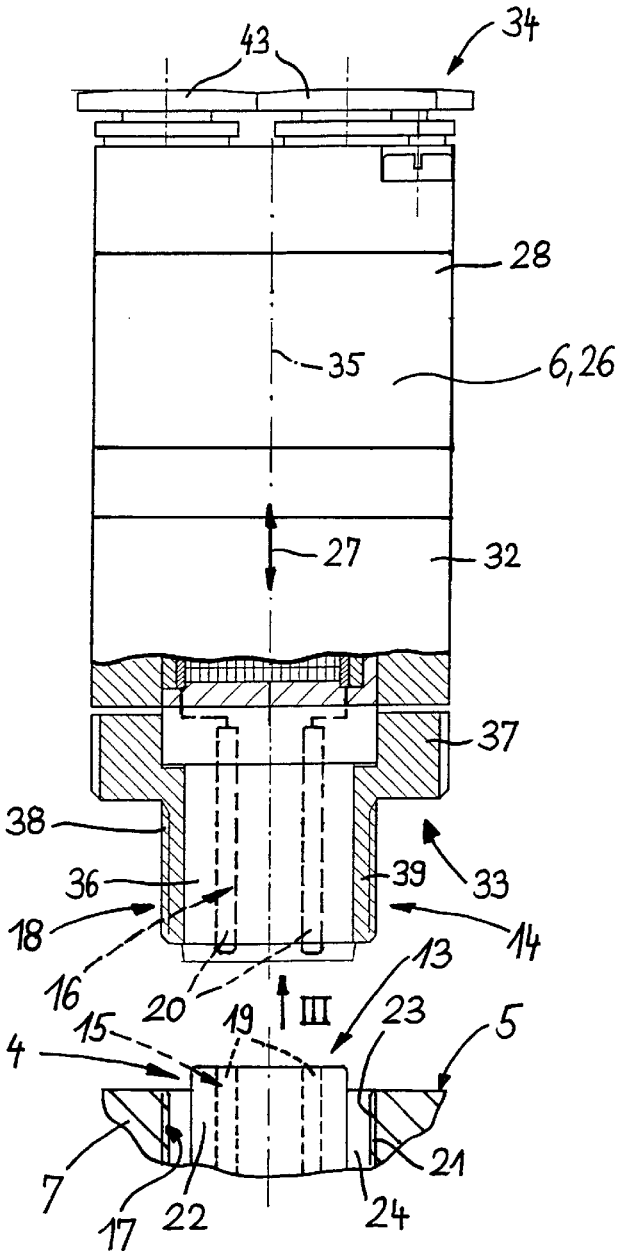
FIG. 2 shows part of the control means of FIG. 1, in which a partly sectioned valve is illustrated at the instant prior to mounting by plugging on an electrical output of the electronic control unit.
Figure 3:
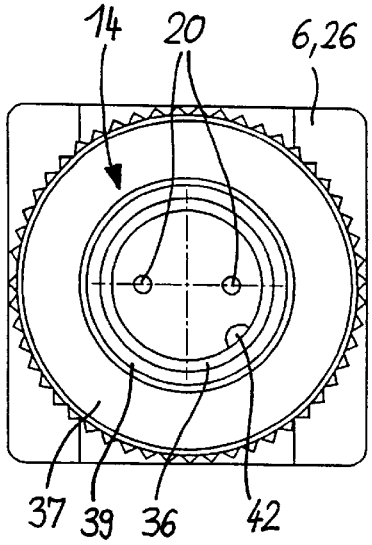
FIG. 3 shows an end-on view of the valve of FIG. 2 looking in the direction of the arrow II toward the second connection means provided on the valve.

FIG. 1 shows a control means 1 adapted for the control of a load, not illustrated in detail, which, dependent on the way it is tailored, may be employed purely as an electronic control means, as a purely electrical cum fluid power control means or as a control means combining several of the above mentioned manners of operation. The working example has design suitable for hybrid operation.

The control means 1 comprises an electronic control unit 2, which preferably does not contain any fluid power components. It possesses a bus connection 3, which is diagrammatically indicated, and is suitable for the connection of a field bus, by way of which a preferably serial exchange of data may take place between the electronic control unit 2 and a superior controller and/or further electronic control units. The field bus may more especially be a so-called ASI bus.

The electronic control unit 2 comprises at least one and preferably a plurality of electrical outputs 4, which are externally accessible and from which the control signal necessary for the operation of electrically operated actuators and/or drive power may be tapped. In the working example of the invention in all four electrical outputs 4 are present, which are arranged spaced apart and adjacent to each other on one and the same connection face 5 of the electronic control unit 2, only one electrical output 4 being visible however. The other electrical outputs 4 are concealed by the connect components 6, which are respectively connected in a detachable manner with the respective electrical output 4.

The electronic control unit 2 has a plate-like configuration, the connection face 5 being constituted by one of the two major external faces. In the case of the alignment indicated the connection face 5 is turned vertically upward.

The electronic control unit 5 possesses a box-like housing 7 for example, in which electronic circuitry 8 is arranged which is only indicated in outline. The electronic circuitry 8 is connected on the one hand with the bus connection 3 and on the other hand with the electrical outputs 4 and more particularly has the purpose of distributing the electrical control signals, supplied by way of the bus connection 3, with the correct association to the electrical outputs 4 present.

An access opening, which is in the working example is covered by a closure body 12, provides access for an operation, which may be mechanical and/or electronic, dependent on the design, on the electronic circuitry 8 of the control unit 2 in order for instance to modify the addresses and connections of the electrical outputs 4.

On the basis of its design and the way it is tailored the electronic control unit 2 may be termed an electronic master controller.

The electrical outputs 4 present are identical in design. In this respect each electrical output 4 is provided with a first connection means 13, which possesses first electrical plug contact means 15 and first mechanical attachment means 17. These means are arranged directly adjacent to one another and grouped together at the respective output 4.

The first connection means 13 and more especially its first electrical plug contact means 15 preferably have a standard architecture. In the working embodiment illustrated this architecture complies with the said German industrial standard DIN EN 60947-5-2. Accordingly, the first electrical plug contact means 15 have in all five first plug contact elements 19, whose distribution is a quincunx, i.e. with four thereof at the corners of a square and one plug contact element in the center of the square.

Preferably, the first plug contact means 15 are, as illustrated, in the form of sockets or jacks, the first plug contact elements 19 exhibiting the configuration of elongated, channel-like recesses and jointly opening at an outwardly facing end face of an associated jack body 22. The first plug contact elements 19 are in electrical contact, in a manner which is not illustrated, with integrated electronic circuitry 8. The socket body 22 extends from the interior space of the housing 7 through a housing opening 23 to the outside, its end face possibly being arranged to project somewhat past the connection face 5.

Between the outer periphery of the socket body 22 and the inner periphery of the housing's opening 23 an annular gap 24 is located. The first mechanical attachment means 17 comprise an internal screw thread 21 provided on the inner periphery of the housing opening 23.

Normally the first plug contact elements 19 are so connected that two diagonally opposite plug contact elements have a power supply voltage of 24 volts (connect number 1) and, respectively, 0 (ground, connect number 3). The two other, diametrally opposite first plug contact elements 19 (connect numbers 2 and 4) are data outputs. The central plug element (connect number 5) is for earthing.

The above mentioned distribution is identical in the case of all electrical outputs 4 present and differences only arise in the actual connection of the contact elements in a manner dependent on the component 6 connected.

If a relay or some other electronic component is to be connected with the electronic control unit, then as a rule the complete connection of the elements will be adhered to. Such an arrangement of contact elements for a load is for example possible using a connect component 6 designed in the form of a connection plug 25, which is indicated diagrammatically in FIG. 1 merely by way of an example. An electric cable, not illustrated in detail, leads from this connection plug 25 to the load to be driven. A different connection of the contact elements will however be regularly selected, when it is a question of a connect component 6 in the form of a valve 26, since in this case specialty features of control technology and more especially simplifying measures must be taken into account.

As was the case with the connection plug 25 in the case of the valves 26 the first connection means 13 serves for making electrical contact and at the same time for mechanically mounting the component 6 in relation to control unit 2. For this purpose each valve 26 possesses a second connection means 14 cooperating with the first connection means 13 in a detachable manner, which comprises second electrical plug contact means 16 for cooperation with the first electrical plug contact means 15 and furthermore second mechanical attachment means 18 for cooperation with the first mechanical attachment means 17.

Each valve is simply connected with the electronic control unit 2 by moving it toward the first connection means 13 with the second connection means 14 to the fore, the first and the second electronic plug contact means 15 and 16 being plugged in by being moved in the direction of plugging as indicated by the double arrow, the mechanical attachment means 17 and 18 fitting into one another and providing a firm mechanical connection between the valve 26 and the electronic control unit 2. Dependent on the particular design of the mechanical attachment means 17 and 18 it is possible for the mechanical attachment engagement to take place automatically on putting the valve 26 in place or it may require an additional active actuating action. In the working embodiment illustrated the latter is the case. In any case the valve 26 in the connected state is electrically contacted and also mechanically held simply by the two first and second connection means 13 and 14, which cooperate with each other. Additional means for making contact or providing mechanical attachment are neither provided nor necessary.

A significant advantage is consequently that on the valve 26 for the connection of same only one second connection means 14 is necessary on the valve 26, such second connection means being adapted to the first connection means 13 present at the electrical output 4. No further measures are required. The valve can hence be connected without any structural alterations in existing electronic control units 2 which were originally designed for purely electronic control purposes.

The valve 26 comprises a valve means 28 of any suitable known design, the details of which are not represented in the drawing. Within the housing of the valve means 28 there is a valve member, which may assume various different this positions of switching in order to control a fluid flow. The switching position of the valve means is preset by an electrically actuated valve drive 32 of the valve 26, which in the working example is mounted on the valve means 28. The valve drive 32 will for instance be in the form of an electromagnetic or a piezoelectric drive.

It is convenient for the second connection means 14 to be directly located on the valve drive 32, it being possible for it to be at least partly an integral component thereof. Accordingly in the connected state of the valves 26 the condition will be such that the valve drive 32 functions as the only support or carrier for the associated the valve means 28.

If as illustrated the valve 26 possesses an elongated shape, the second connection means 14 and preferably also the valve drive 32 will be on a first face 33 of two end faces 33 of the two end faces of the valve 26. The arrangement is in this case more particularly such that the direction 27 of plugging coincides with the longitudinal axis 35 of the valve 26 so that the longitudinal axis of the attached valve extends athwart the principal direction of extent of the electronic control unit 2, which in the working example extends parallel to the connection face 5. Accordingly a plurality of connection components 6 may be compactly arranged alongside each other.

In the working embodiment illustrated the second electrical plug contact means 16 represent a plug, which has a plurality of pin-like second plug contact elements 20 extending in parallelism to the direction 27 of plugging. These second plug contact elements 20 are surrounded by a sleeve 36 centered on the longitudinal axis 35, on which, again coaxially, a screw part 37 is mounted for free rotation while all the same being held to generally prevent axial movement. The screw part 37 possesses an annular section 39 extending toward the free end of the sleeve 36, such section 39 being provided with an external screw thread 38. The same is complementary to the internal screw thread 21 of the first mechanical attachment means 17.

During mounting of the valve 26 by a plugging action the sleeve 36 is plugged onto the socket body 22, the pin-like second plug contact elements 20 being fitted into the channel-like first plug contact elements 19. For mechanically fixing the screw part 37 is manually turned about the longitudinal axis 35 so that the screw threads of the two mechanical attachment means 17 and 18 come into engagement and the valve 26 is drawn toward the outer face 5 of the electronic control unit 2. The screw part 37 may then be clamped against the housing 7 so that the valve 26 is securely held.

The number of the second plug contact elements 20 is dependent on the functionality of the valve drive 32 supplying them with electrical power. If the valve drive 32 is operated with a low voltage, as for instance 24 volts, two second plug contact elements 20 will suffice, which in the connected state make plug contact with the first plug contact elements 19 with the connection numbers "1" and "3". An electrical connection of the remaining three first plug contact elements 19 is unnecessary in this case.

If valve drives 32 are employed requiring a higher operating voltage, as for instance of the order of 110 volt or 230 volts, a further middle plug contact element can be provided between the two illustrated second plug contact elements 20, which middle element serves for making contact with the middle contact element 20 for grounding same. This particular design is not illustrated in the drawings.

Between the electronic control unit 2 and the respective valve 26 there are, in the connected state, merely mechanical and electrical connections, whereas fluid power connections and interfaces are not present.

In order to ensure plugging of the valve 26 in position without any risk of polarities being reversed by plugging in the wrong sockets, the two connection means 13 and 14 are provided with positioning means 42, which render possible plugging in only one definite angular setting. In the working embodiment illustrated such positioning means 42 comprise a longitudinal groove provided on the outer periphery of the socket or jack body 32 and a preferably rib-like projection, complementary to it, on the inner face of the sleeve 36.

The fluid flows to be controlled by the valve means 28 are supplied and let off by way of fluid ducts, which may be detachably connected with fluid duct connections 43 provided on the valve 26. The fluid duct connections 43 can be designed in the form of plug connection means. It is in any case an advantage for all fluid duct connection 43 to be provided on the side, which is opposite to the second connection means 14, of the valve 26, that is to say, in the embodiment, on the second end side 34 opposite to the first end side 33. The peripheral part, which is clear of the longitudinal axis 35, of the valve 26 consequently remains completely free of any connection means whatsoever, something which then permits the fitting of an electronic control unit 2 with valves 26 even in cases, when their electrical outputs 4 are placed with only a small distance between them.

Since with the exception of the second connection means not one component of the valve 26 is in contact with the electronic control unit 2 or with any other component of the control means 1, all surfaces are readily accessible and intermediate gaps are avoided, something which helps prevent the collection of dirt and facilitates cleaning.

What is claimed is:

1. A control means comprising an electronic control unit having a bus connection, electronic circuitry and at least one electrical output, the electrical output being provided with a first connection means exhibiting first electrical plug contact means and first mechanical attachment means, such first connection means serving for making electrical contact and at the same time for mechanical attachment for a connect component, such connect component possessing a second connection means cooperating in a detachable manner with the first connection means, such connection means having second electrical plug contact means and second mechanical attachment means, wherein the connect component is directly constituted by an electrically actuated valve, which is exclusively electrically contacted and mechanically mounted with the aid of the mutually cooperating connection means.

2. The control means as set forth in claim 1, wherein the second connection means is provided on an electrically actuated valve drive of the valve, adapted to function as the sole carrier means for the valve means of the valve.

3. The control means as set forth in claim 1, wherein the valve possesses an elongated shape, the second connection means being located on an end face of the valve.

4. The control means as set forth in claim 3, wherein the longitudinal axis of the valve runs athwart the principal plane of extent of the control unit.

5. The control means as set forth in claim 1, wherein the control unit possesses a plate-like or tabular shape, the at least one electrical output being provided on one of the two major outer sides thereof.

6. The control means as set forth in claim 1, wherein the one plug contact means are designed in the form of plugs and the other electrical plug contact means are designed in the form of sockets.

7. The control means as set forth in claim 1, wherein the first electrical plug contact means possesses first plug contact elements in quincunx arrangement, the second electrical plug contact means exhibiting at least two second plug contact elements, which are so designed that same are able to be electrically contacted by the first plug contact elements of the first plug contact means.

8. The control means as set forth in claim 7, wherein the pattern of the plug contact means of the first plug contact elements complies with the German industrial standard DIN EN 60947-5-2.

9. The control means as set forth in claim 1, wherein the valve is provided with fluid duct connections for the connection of fluid ducts leading to equipment external to the control means.

10. The control means as set forth in claim 9, wherein all fluid duct connections are arranged on the side, which is opposite to the second connection means, of the valve.

11. The control means as set forth in claim 1, wherein the mechanical attachment means cooperating together mutually are constituted by screw means.

12. The control means as set forth in claim 1, wherein the control unit comprises a plurality of electrical outputs, same being at least partially fitted with valves.

13. The control means as set forth in claim 1, wherein the electronic control unit is free of fluid power components.

14. The control means as set forth in claim 1, wherein the valve is fitted with an electromagnetic and/or piezoelectric valve drive.

15. An electrically actuated valve, comprising a second connection means for direct connection with a first connection means of an electrical output, of an electronic control unit, the second connection means having second electrical plug contact means, for cooperating with first electrical plug contact means of the first connection means, the second electrical plug contact means of the valve enabling a direct electrical contact connection with the first electrical plug contact means of the control unit, and having plug contact elements in a quincunx pattern.

16. An electrically actuated valve comprising a plug for mechanically and electrically connecting the valve to an electrical output of an electronic control unit, said plug including a plurality of electrical plug contact elements, a sleeve surrounding said plug contact elements and a screw part coaxially mounted on said sleeve, said screw part being rotatable with respect to said sleeve and including an annular section having an external screw thread for engaging an internal screw thread of the electrical output of the electronic control unit.

* * * * *